US009945548B2

(12) United States Patent
Williams et al.

(10) Patent No.: US 9,945,548 B2
(45) Date of Patent: Apr. 17, 2018

(54) RECESSED LIGHTING UNIT WITH WIRE CONNECTOR

(71) Applicant: DMF, Inc., Carson, CA (US)

(72) Inventors: Vincent P. Williams, Carson, CA (US); Michael Moss, Hermosa Beach, CA (US); Michael D. Bailey, Long Beach, CA (US)

(73) Assignee: DMF, Inc., Carson, CA (US)

( * ) Notice: Subject to any disclaimer, the term of this patent is extended or adjusted under 35 U.S.C. 154(b) by 256 days.

(21) Appl. No.: 14/823,410

(22) Filed: Aug. 11, 2015

(65) Prior Publication Data

US 2017/0045213 A1 Feb. 16, 2017

(51) Int. Cl.

| | |
|---|---|
| ***F21V 23/06*** | (2006.01) |
| ***F21V 29/76*** | (2015.01) |
| ***F21S 8/02*** | (2006.01) |
| *F21V 21/04* | (2006.01) |

(52) U.S. Cl.

CPC ..... *F21V 23/06* (2013.01); *F21S 8/02* (2013.01); *F21V 29/763* (2015.01); *F21V 21/04* (2013.01)

(58) Field of Classification Search

CPC ..... Y10T 403/58; Y10T 403/7061; Y10T 403/4045; F16B 21/18; F16B 21/183; F16B 21/186; F21V 23/06; F21V 29/763; F21V 21/04; F21V 21/044; F21S 8/02

USPC ..... 362/148, 150, 364, 365, 366; 403/315, 403/372, 376

See application file for complete search history.

(56) References Cited

U.S. PATENT DOCUMENTS

| | | | | |
|---|---|---|---|---|
| 7,534,014 | B1 * | 5/2009 | Pelletier | F21S 8/02 362/147 |
| 2015/0150216 | A1 * | 6/2015 | Lindvall | A01K 9/00 119/71 |

* cited by examiner

*Primary Examiner* — Laura Tso

(74) *Attorney, Agent, or Firm* — Womble Bond Dickinson (US) LLP

(57) ABSTRACT

A recessed lighting unit for mounting to a ceiling or a wall is provided. The recessed lighting unit includes an interface module having a through-duct. The through-duct may be coupled to a wire connector assembly to secure an electrical wire to the interface module and allow the electrical wire to reach a light source module. The wire connector assembly may be twisted and locked to the interface module without the use of tools. The lighting trim may be snapped on to an interface module through the use of a flexible retainer ring. The lighting trim may also be twisted and locked to an interface module without the use of tools. The present invention provides for a reduced set of components while ensuring adaptability and easy installation of lighting units. Other embodiments are also described and claimed.

24 Claims, 21 Drawing Sheets

RECESSED LIGHTING UNIT WITH WIRE CONNECTOR

FIELD

An embodiment of the invention relates to a recessed lighting unit that is mounted behind a ceiling or a wall via its interface module. Other embodiments are also described.

BACKGROUND

Recessed lighting units are typically installed or mounted to a structural member of a dwelling behind a ceiling or a wall. Recessed lighting units generally consist of various components of different shapes and sizes. For example, different styles of trims and light source modules may be used to accommodate different needs of consumers.

Although current recessed lighting units come in a variety of shapes and sizes, switching between different components can be tedious and cumbersome. In particular, current systems require the removal of numerous screws and fasteners to change a single component of the system, such as a trim. Thus, there is a need for a lighting system that enables efficient interchangeability between different components.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
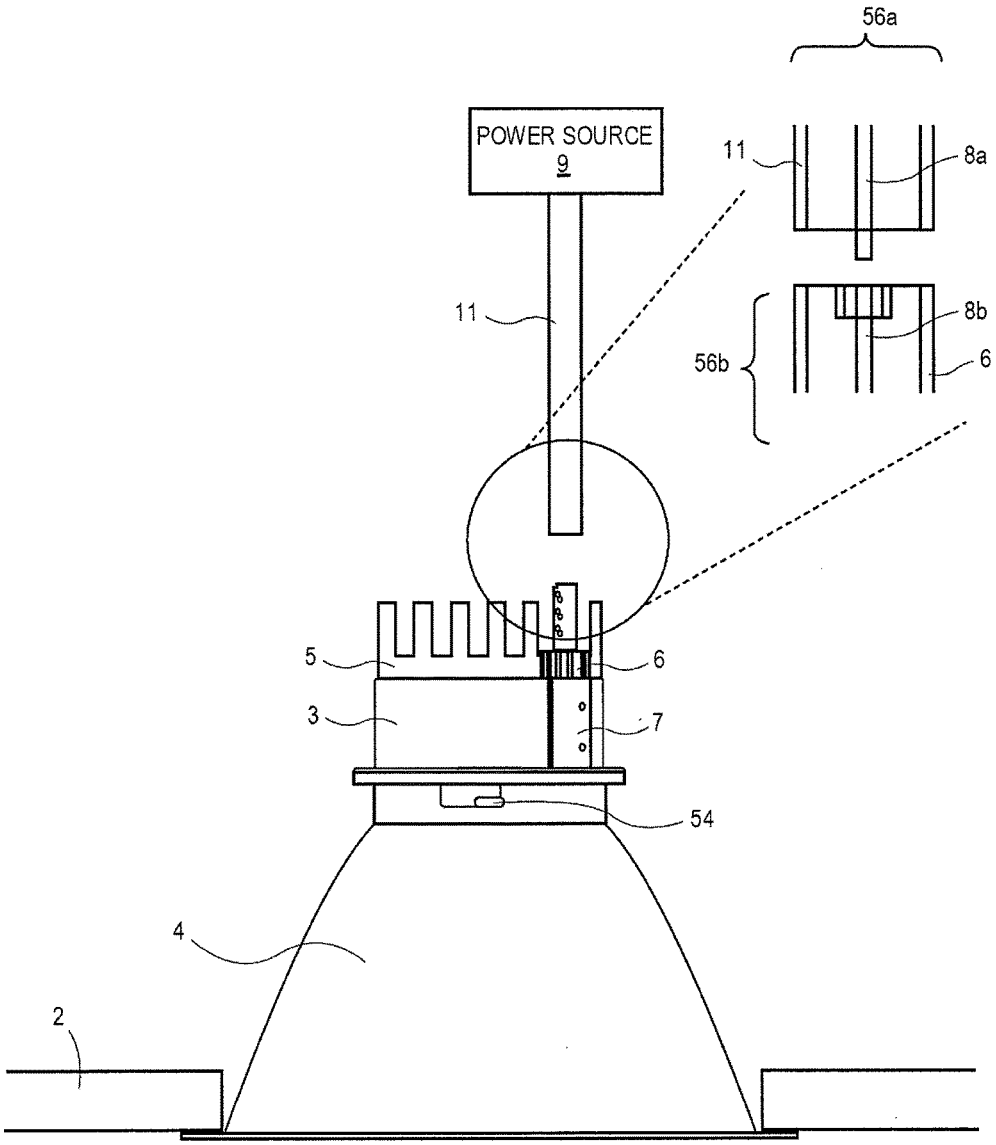
FIG. 1 shows a side view of a recessed lighting unit and its components positioned partly inside a ceiling or a wall, including an interface module, lighting trim, heat sink, wire connector assembly, electrical wires, power source, and flexible conduit according to one embodiment.

A recessed lighting unit 1 is disclosed. FIG. 1 shows a side view of one embodiment of a recessed lighting unit 1 that is positioned on a ceiling or wall 2 to provide light into a room. The recessed lighting unit 1 may have an interface module in the form of a housing 3 that is coupled to a lighting trim 4, heat sink 5, and a wire connector assembly 6 that is engaged to a through-duct 7 of the housing 3. The lighting trim 4 of the recessed lighting unit 1 may cover the exposed edge of an opening or hole in the ceiling or wall 2. The lighting trim 4 helps the recessed lighting unit 1 to appear seamlessly integrated into the ceiling or wall 2. The housing 3 may be formed so that it may be coupled to lighting trims 4 of different sizes. The housing 3 serves to house a light source module 10 (shown in FIG. 2) while allowing light from the light source module 10 to be emitted into a room through the opening in the ceiling or wall 2.

FIG. 1 also shows a magnified cross-section view of an electrical wire 8*a* which may be connected to a power source 9 that provides electricity. The power source 9 (which may include an electronic power supply circuit) is designed to ensure that the appropriate voltage and current are fed to the light source module 10 to enable the emission of light by the one or more light sources within the light source module 10. In one embodiment, an AC to DC power conversion module with a 120 Volt AC input may be used whose input is connected to the AC wiring that is between the walls 2 or between a ceiling 2 and a floor in a dwelling (not shown). In one embodiment, the AC to DC power conversion module can be integrated as part of the light source module 10.

The electrical wire 8*a* may be surrounded by a flexible conduit 11. There may be one or more insulating layers in between the electrical wire 8*a* and the flexible conduit 11. The electrical wire 8*a* may be led through the flexible conduit 11 and attached to one or more electrical contacts at the end of the flexible conduit 11. In one embodiment, flexible conduit 11 with electrical wire 8*a* may be a coaxial cable with one or more electrical contacts attached to its end, forming a coaxial connector 56*a*.

The flexible conduit 11 with one or more electrical contacts that forms a coaxial connector 56*a* may be engaged to the wire connector assembly 6 (which may have a female component 22 and a male component 23, discussed in further detail below). A top end of the wire connector assembly 6 may have an electrical wire 8*b* attached to a coaxial connector 56*b*. The electrical wire 8*b* may be surrounded by an insulating layer. The electrical wire 8*b* may be connected to the light source module 10 located inside the housing 3. The electrical wire 8*b* may be led from the light source module 10 through a hollow interior of the wire connector assembly 6 and through the through-duct 7 of the housing 3. When the flexible conduit 11 is engaged or coupled to wire connector assembly 6, the electrical contacts of both electrical wires 8*a* and 8*b* would come into contact as the coaxial connectors 56*a* and 56*b* are engaged. The electrical contact of the electrical wire 8*a* attached to the flexible conduit 11 may be male or female, as long as it is complementary to the electrical contact of the electrical wire 8*b* attached to the wire connector assembly 6.

Figure 2:
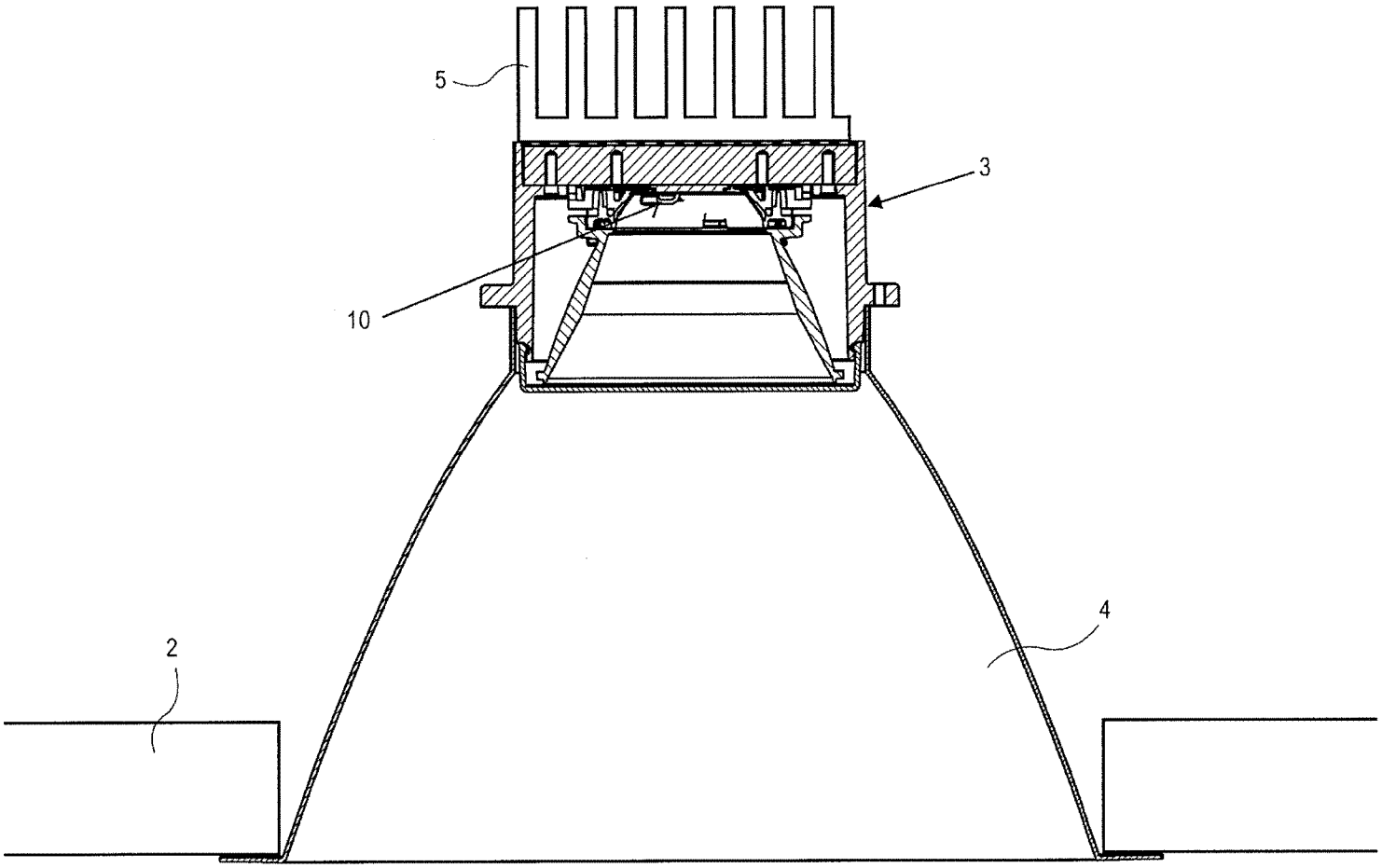
FIG. 2 shows a cross-section view of a recessed lighting unit and its components positioned partly inside a ceiling or a wall, including an interface module, lighting trim, heat sink, and light source module, according to one embodiment.

FIG. 2 shows a cross-section view of the recessed lighting unit 1 that is positioned on a ceiling or wall 2. The recessed lighting unit 1 has a housing 3, lighting trim 4, heat sink 5, and light source module 10. The light source module 10 may include any electro-optical device or combination of devices for emitting light. For example, the light source module 10 may have as a single light source a light emitting diode (LED), organic light-emitting diode (OLED), or polymer light-emitting diode (PLED) installed on a carrier structure (e.g., a printed circuit board or flex circuit). In some embodiments, the light source module 10 may have multiple light sources (e.g., LEDs, OLEDs, and/or PLEDs). The light source module 10 receives electricity from a power source 9 such that the light source module 10 may emit a controlled beam of light into a room or a surrounding area. In one embodiment, the light source module 10 may include a set of electrical leads positioned in its carrier structure, for receiving electricity from the power source 9 via electrical contacts. The electrical leads of the light source module 10 may be soldering points that are traditionally coupling areas for electrical wires 8*b* that are directly soldered to the light source module 10 and directly connect the light source module 10 with the power source 9. The light source module 10 may be surrounded by a light reflector 55 (shown in FIG. 18) to direct the beam of light in the desired direction.

Figure 3:
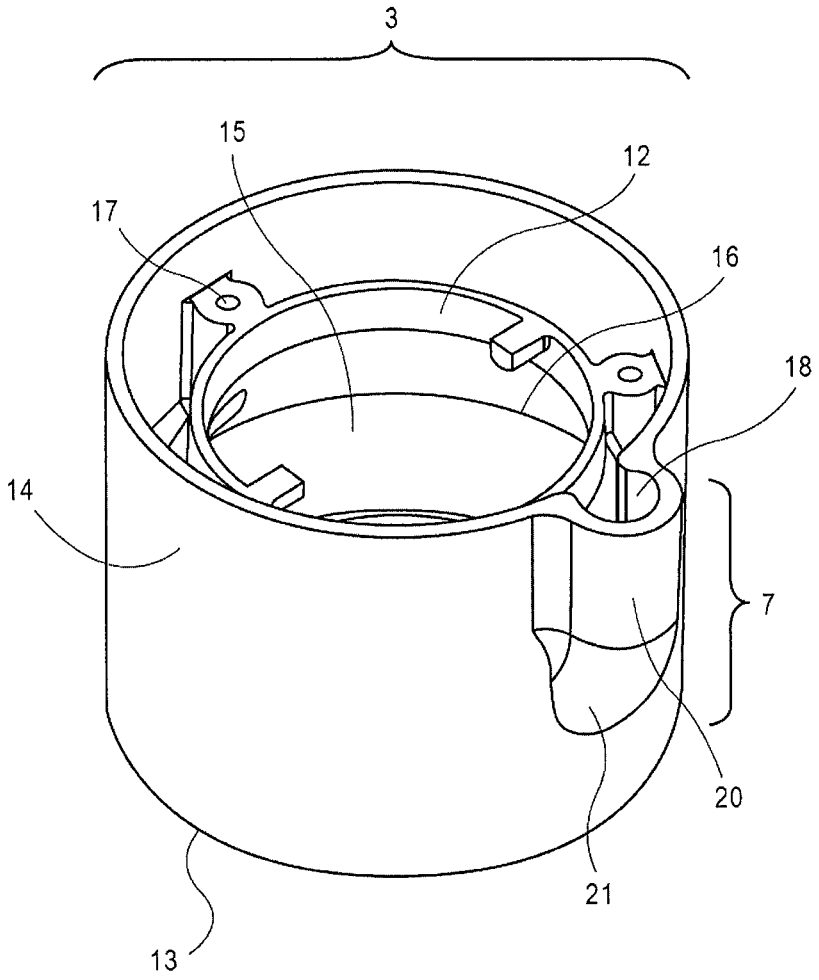
FIG. 3 shows a perspective view of the interface module according to one embodiment.
Figure 4:
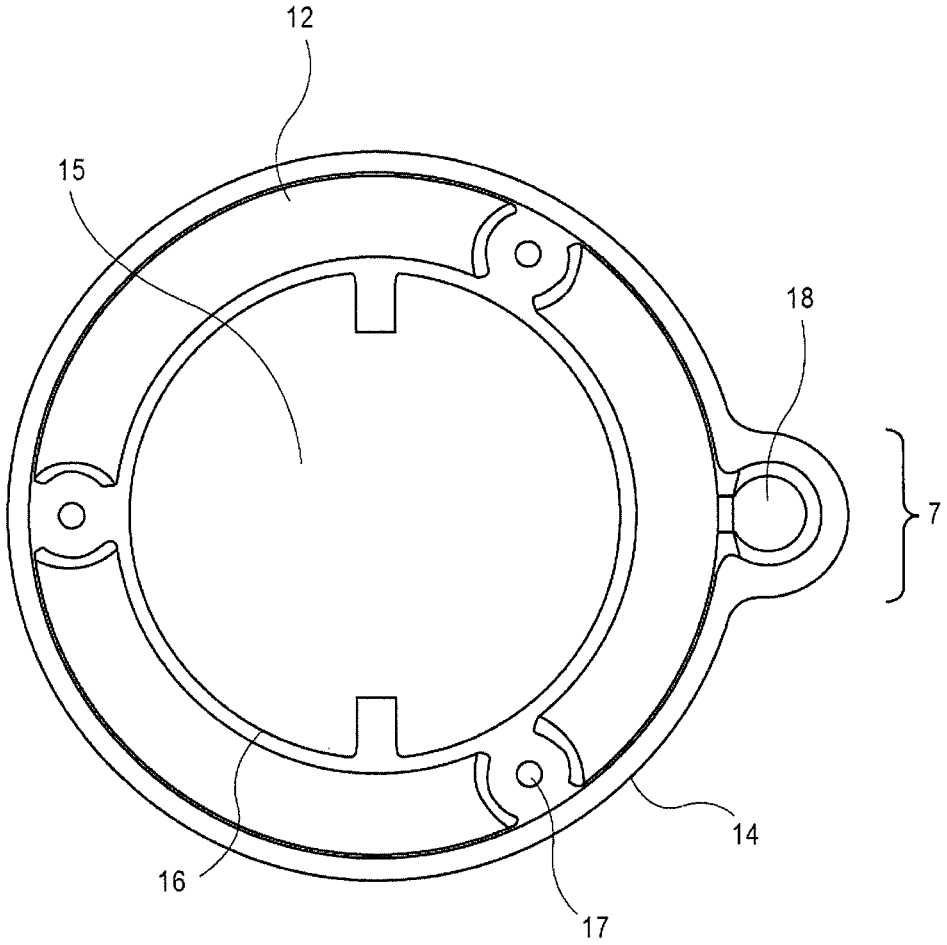
FIG. 4 shows an overhead view of the interface module according to one embodiment.
Figure 5:
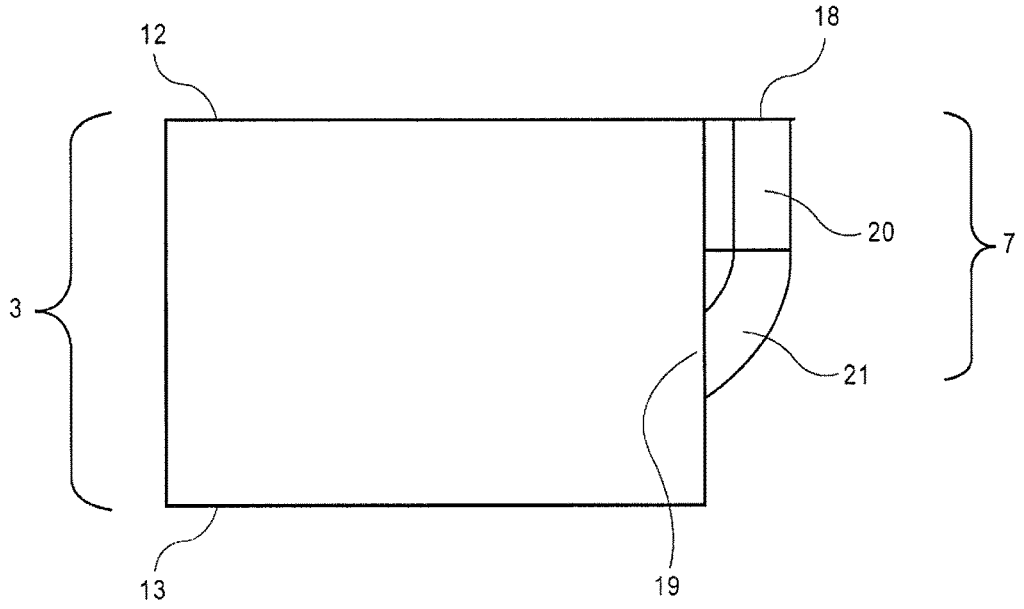
FIG. 5 shows a side view of the interface module according to one embodiment.

FIGS. 3-5 show a perspective view, an overhead view, and a side view of one embodiment of an interface module in the form of a housing 3. As shown in FIG. 3, the interface module is a housing 3 in which a top opening 12 and a bottom opening 13 are formed in an outer surface 14 of the housing 3, wherein the top 12 and bottom 13 openings are open to a cavity 15. Cavity 15 is defined in part by an inner surface 16 of the housing 3. One or more screw holes 17 may be positioned on the housing 3 so that they are accessible through the top opening 12 or bottom opening 13, which may receive screws for attaching a heat sink 5, for example, to the housing 3.

FIG. 3 also shows the housing 3 having a through-duct 7 formed thereon, which may allow connection of an electrical wire 8*a* from a power source 9 located outside of the housing 3 to an electrical wire 8*b* connected to a light source module 10 located inside of the housing 3. Connection of electrical wires 8*a* and 8*b* may be accomplished via a wire connector assembly 6 as described above. Through-duct 7 may be engaged to a wire connector assembly 6, i.e. a male component 23 and female component 22 (in embodiments where there is no female component 22, as described below, the male component 23 may be referred to as a wire connector 23). Thus, the through-duct 7 allows the flexible conduit 11 to be secured to the housing 3 through a wire connector assembly 6. As shown in FIG. 5, the through-duct 7 has a first through-duct opening 18 in the outer surface 14 that leads to a second through-duct opening 19 in the inner surface 16. The through-duct 7 forms a pathway between the first through-duct opening 18 in the outer surface 14 and the second through-duct opening 19 in the inner surface 16. In one embodiment, the through-duct 7 may have an upper portion 20 and a lower portion 21, between the first through-duct opening 18 and the second through-duct opening 19. As shown in FIG. 3 and FIG. 5, an embodiment of the housing 3 may have a lower portion 21 that forms an elbow between the upper portion 20 and the second through-duct opening 19. In another embodiment, the pathway of the through-duct 7 need not have an elbow, and may be shaped to form a right circular cylinder, an oblique circular cylinder, or a polygonal tube. The pathway may have one or more bends. In the case of a right circular cylinder, the cylinder would be oriented horizontally relative to the housing 3. In that case, it follows that the wire connector assembly 6 would also be positioned horizontally. Where the through-duct 7 is shaped as an oblique circular cylinder, shape of the wire connector assembly 6 may conform to the shape of the through-duct 7.

FIGS. 3, 4 and 5 show an embodiment where the through-duct 7 forms a bulge or protrusion that extends outwardly. However, it is not necessary to have a bulge or protrusion formed on the outer surface 14 in order to form through-duct 7. In another embodiment, outer surface 14 may be made with increased thickness so that through-duct 7 is subsumed by the outer surface 14, allowing for a smooth or uninterrupted outer surface 14 without a bulge or protrusion. In another embodiment, outer surface 14 may have a greater circumference so that the through-duct 7 is formed inside of the circumference. In these embodiments, the shape of the interior of through-duct 7, with its upper portion 20 and lower portion 21, may remain the same.

In one embodiment, as shown in FIG. 3, the first through-duct opening 18 and the upper portion 20 may be completely or partially enclosed. Also, top opening 12 may be completely or partially enclosed. FIG. 3 shows an embodiment where the first through-duct opening 18 and the upper portion 20 are partially enclosed. FIG. 3 also shows an embodiment where the top opening 12 and the first through-duct opening 18 are contiguous with each other. In another embodiment, the top opening 12 and the first through-duct opening 18 need not be contiguous with each other. The first through-duct opening 18 need not have the same height as the top opening 12. The first through-duct opening 18 may be higher or lower than the top opening 12, and may have an angle. Also, the through-duct 7 need not be strictly vertical at the upper portion 20 and may be formed at an angle.

Figure 6:
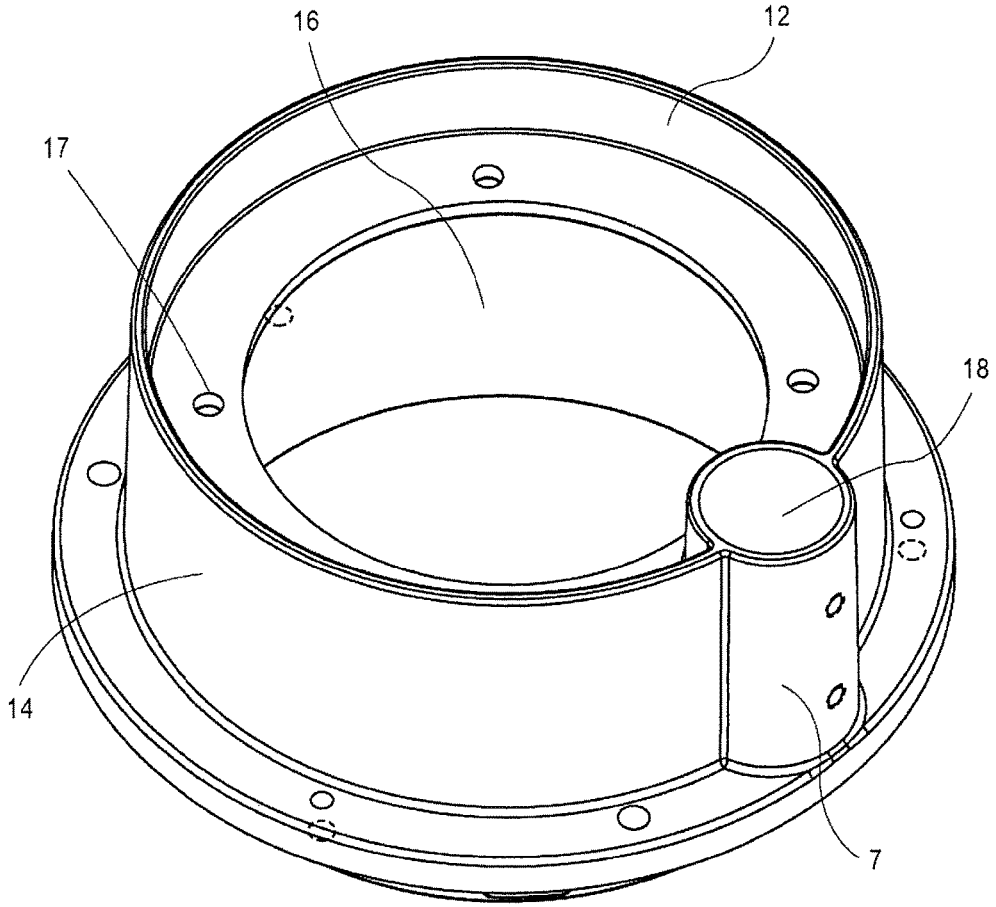
FIG. 6 shows a perspective view of an interface module according to another embodiment.
Figure 7:
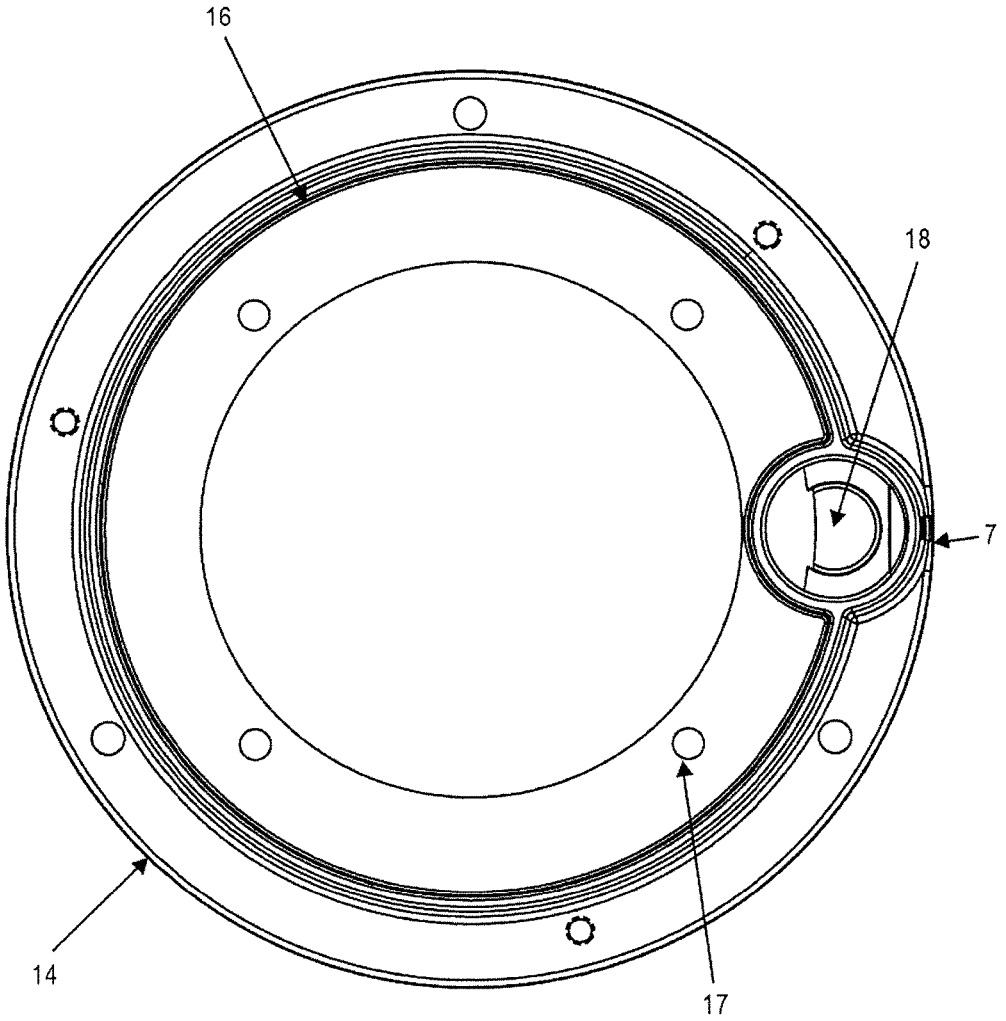
FIG. 7 shows an overhead view of the interface module according to another embodiment.
Figure 8A:
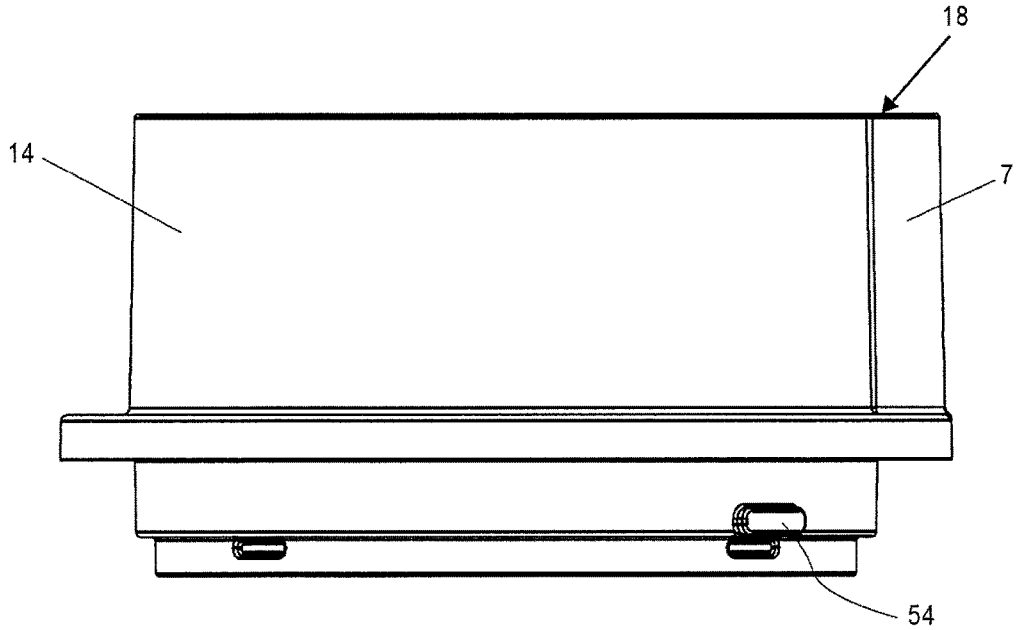
FIG. 8*a* shows a side view of the interface module according to another embodiment.
Figure 8B:
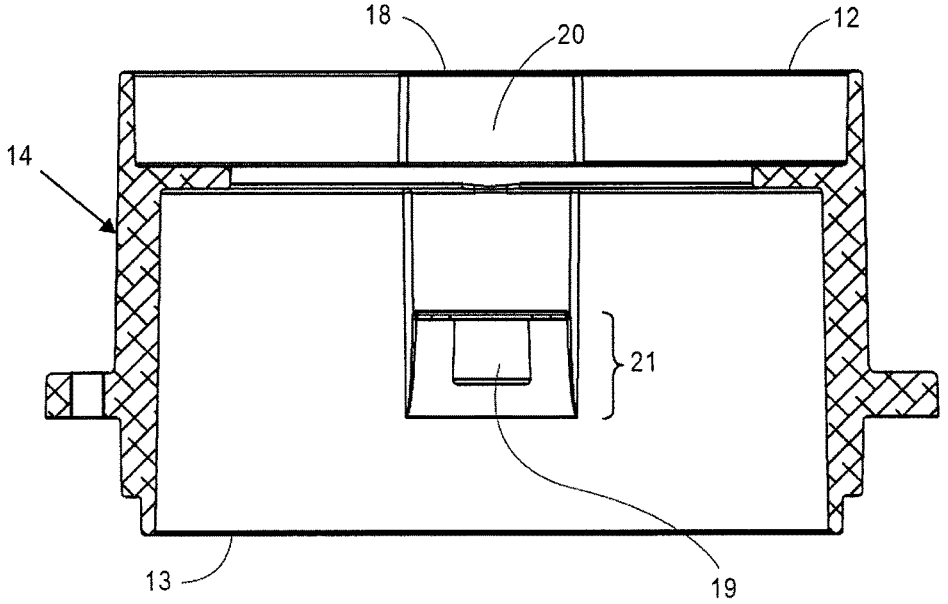
FIG. 8*b* shows a cross section view of the interface module according to another embodiment.

FIGS. 6-8*b* show another embodiment of housing 3. For example, FIG. 6 shows the through-duct 7 having a first through-duct opening 18 in the outer surface 14 that leads to a second through-duct opening 19 in the inner surface 16 (as shown in FIG. 8*b*). FIG. 8*b* also shows the through-duct 7 having an upper portion 20 and a lower portion 21, between the first through-duct opening 18 and the second through-duct opening 19. The lower portion 21 may form an elbow between the upper portion 20 and the second through-duct opening 19. However, as described above, through-duct 7 need not have an elbow, and may be shaped to form a right circular cylinder, an oblique circular cylinder, or a polygonal tube. In this embodiment, the first through-duct opening 18 is completely enclosed. The top opening 12 is interrupted by the first through-duct opening 18 and through-duct 7, but the top opening 12 and the first through-duct opening 18 are not contiguous with each other like the embodiment shown in FIGS. 3-5.

Figure 10:
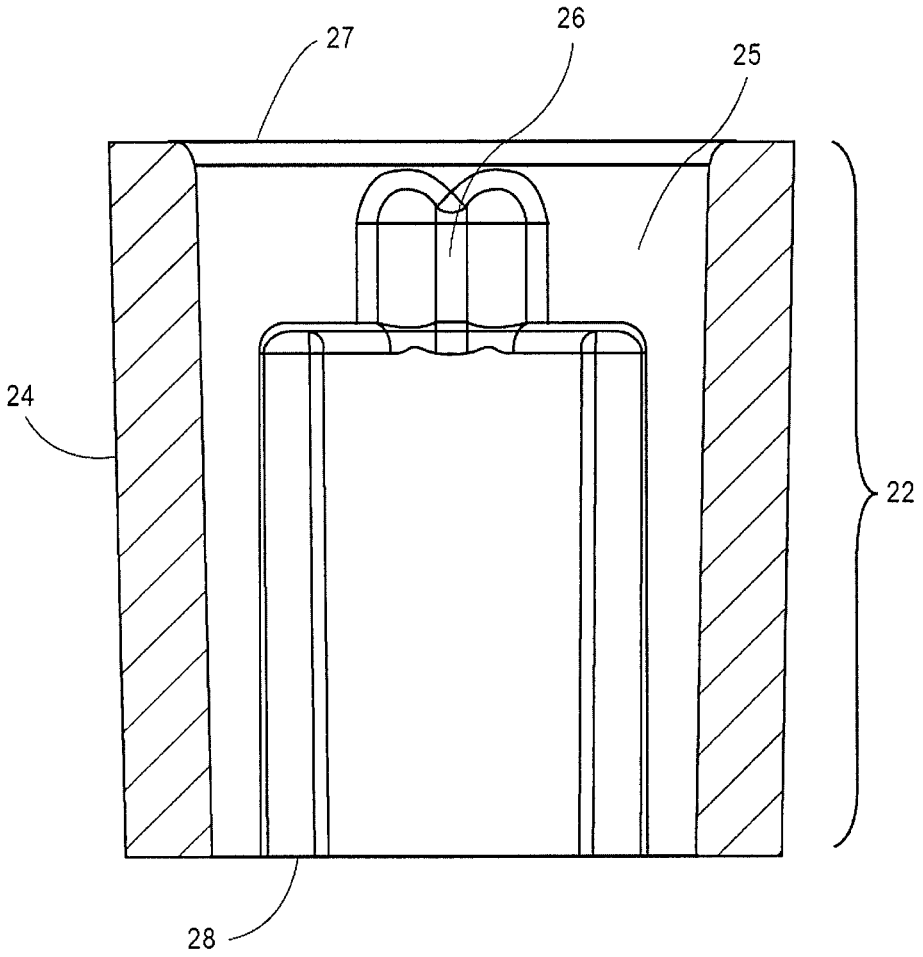
FIG. 10 shows a cross-section view of the female component of a wire connector assembly according to one embodiment.
Figure 11:
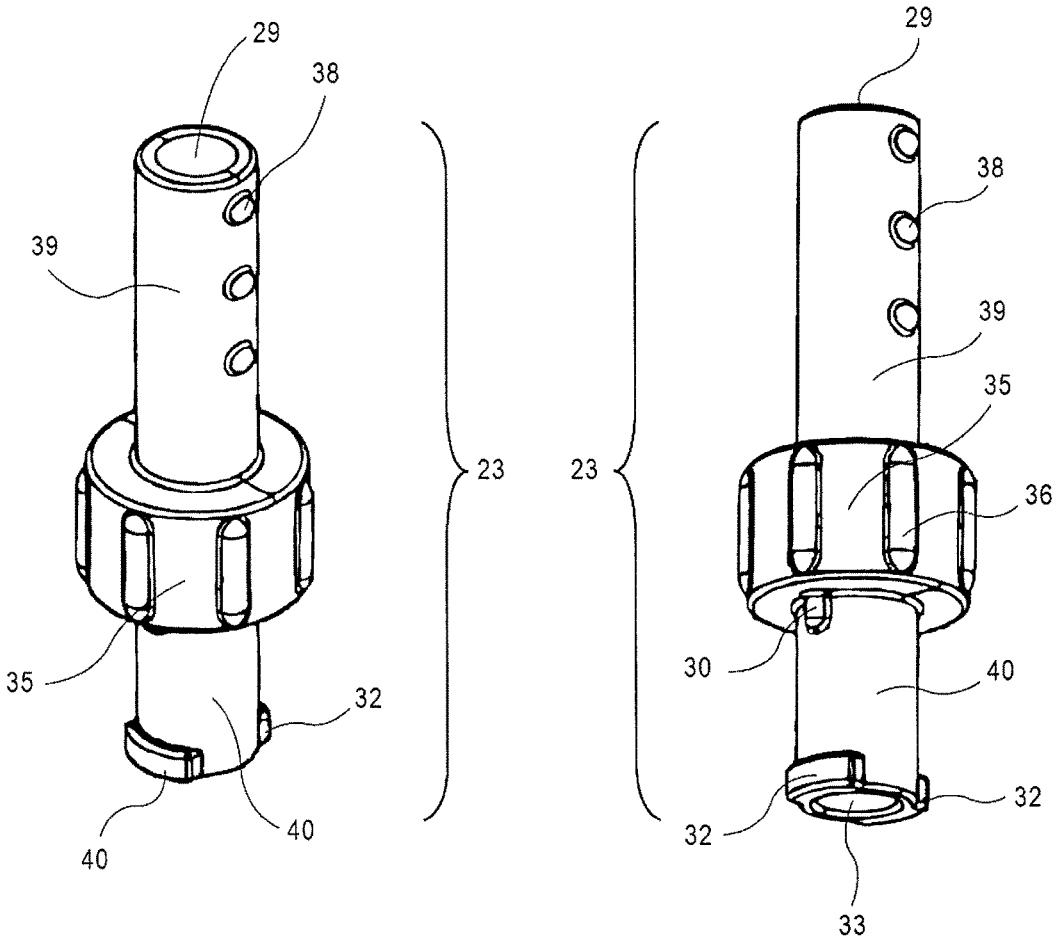
FIG. 11 shows two perspective views of a male component of the wire connector assembly according to one embodiment.
Figure 12:
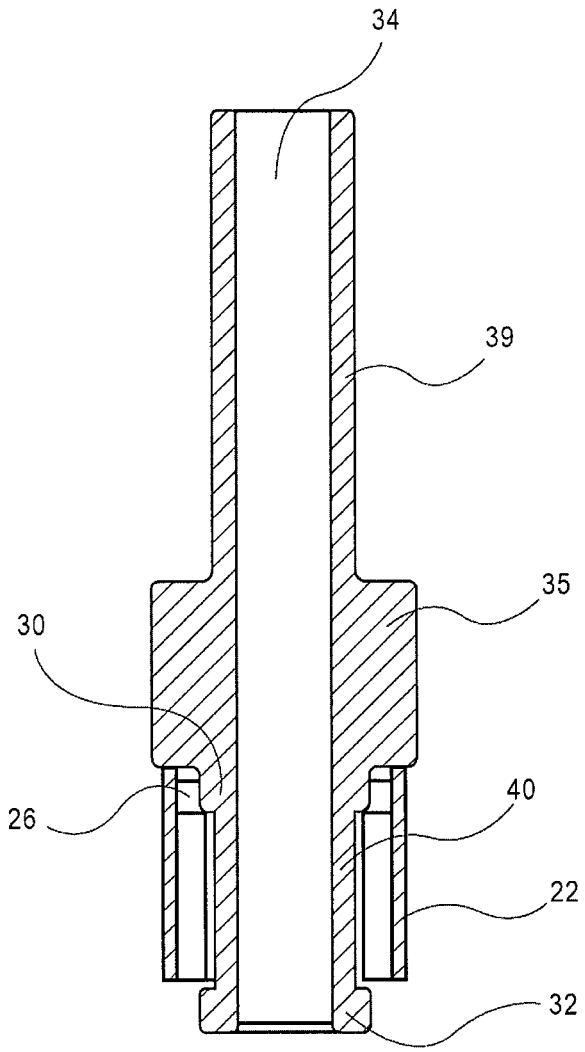
FIG. 12 shows a cross section view of the wire connector assembly according to one embodiment.

As described above, the through-duct 7 may provide a pathway for the electrical wire 8*b* that is led from the light source module 10 inside of the cavity 15 of the housing 3 to connect with electrical wire 8*a* led from the power source 9. The connection of the electrical wires 8*a* and 8*b* are secured to the housing 3 by the wire connector assembly 6 being engaged to the through-duct 7. The wire connector assembly 6 may have a female component 22 (FIGS. 9 and 10) and a male component 23 (FIGS. 11 and 12). The female component 22 and male component 23 form a twist and lock mechanism where the male component 23 is inserted into the female component 22 and twisted into a locked position. The first through-duct opening 18 is shaped so that it is capable of having the female component 22 of the wire connector assembly 6 positioned inside upper portion 20. The female component 22 may be keyed into upper portion 20 so that the female component 22 does not easily fall out of the upper portion 20. The female component 22 may also be attached to the upper portion 20 by glue, screws, snapping mechanism, and the like. Once the female component 22 is positioned inside the upper portion 20, the male component 23 can be engaged to the female component 22.

Figure 9:
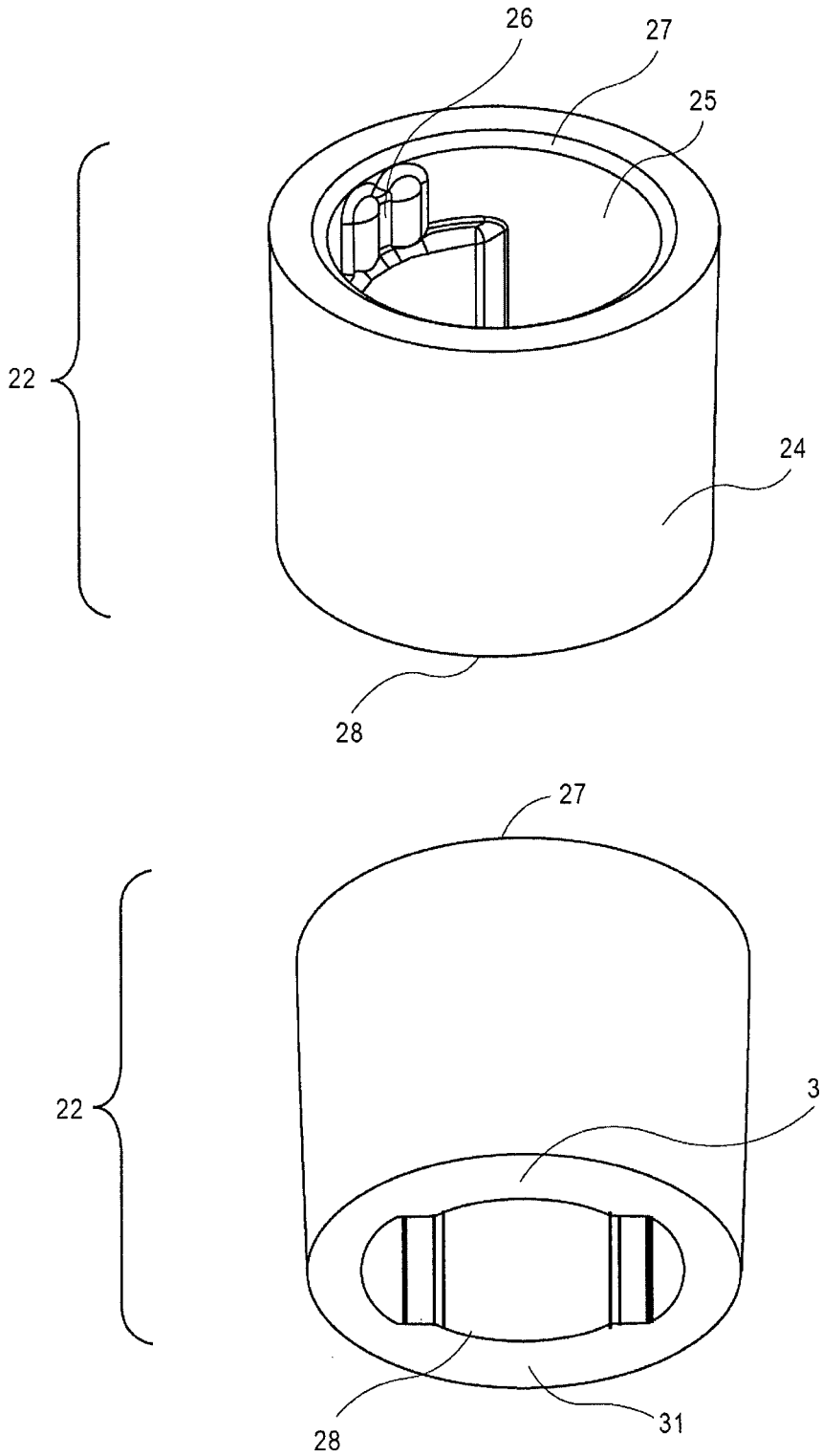
FIG. 9 shows two perspective views of female component of a wire connector assembly according to one embodiment.

FIG. 9 shows two perspective views of female component 22. FIG. 10 shows a cross section view of female component 22. The female component 22 of a wire connector assembly 6 has an exterior surface 24, an interior surface 25, a top opening 27, and a bottom opening 28. FIG. 12 shows a cross-section view of the wire connector assembly 6 with the female component 22 and male component 23 engaged in a locked position through a twist and lock mechanism. The twist and lock mechanism is formed by the female component 22 having one or more locking engagements 26 formed on the interior surface 25 that are shaped to engage one or more locking members 30 formed on an exterior surface of the male component 23. The male component 23 and female component are locked when the male component 23 is inserted into the female component 22 and turned about its longitudinal axis into a locked position. The locking member 30 and locking engagement 26 may have a variety of shapes, as long as they are formed to engage each other to form a locking mechanism.

The female component 22 may have one or more retaining surfaces 31 that abut one or more retaining lips 32 of a male component 23 of the wire connector assembly 6 when the male component 23 of the wire connector assembly 6 inserted into the female component 22 and is turned about its longitudinal axis into a locked position. The one or more retaining surfaces 31 may abut one or more of retaining lips 32 of the male component 23 of the wire connector assembly 6 when one or more of the locking engagements 26 are engaged to one or more of locking members 30. The one or more retaining surfaces 31 need not always be in direct contact with the one or more retaining lips 32. There may be a small gap in between the retaining surface 31 and retaining lip 32. While there may be a small gap, when the male component 23 is pulled upwards while in a locked position, the retaining lip 32 would contact the retaining surface 32 and prevent the male component 23 from being pulled out. In order to pull out the male component 23, one must twist the male component 23 to unlock it from the female component 22 by twisting it longitudinally into an unlocked position.

FIG. 11 shows two perspective views of the male component 23 of the wire connector assembly 6, according to one embodiment. The male component 23 of the wire connector assembly 6 has a top end with an opening 29 and a bottom end with an opening 33, and a hollow interior 34 running longitudinally from the top end to the bottom end. While not shown in FIG. 11, there may be an electrical wire 8*b* attached to the top opening 29 of the male component 23 that forms a coaxial connector 56*b*, as described above. The male component 23 has one or more retaining lips 32 that extend outwardly from the bottom end. The male component 23 also has a grip section 35 formed on the exterior surface of the male component 23 of the wire connector assembly 6 between the top end and the bottom end. The grip section 35 may have one or more knurls 36 that provide friction for a user to twist the male component 23 by hand without the need for tools. While the use of knurls 36 is one way to provide friction, knurls 36 are not absolutely necessary, as there are other ways of providing friction. The grip section 35 may have ridges, sawtooth surface, or the like, that provide friction for a user's fingers. The male component 23 has one or more locking members 30 on the lower exterior surface 40 of the male component 23 of the wire connector assembly 6 between the grip section 35 and the bottom end. The locking members 30, as explained above, may engage to locking engagements 26 of the female component 22.

Once the bottom end of the male component 23 is inserted into a top opening 27 of the female component 22 so that the retaining lips 32 pass beyond the bottom end of the female component 22, the male component 23 may be twisted by hand by gripping the grip section 35. Because the retaining lips 32 of the male component 23 must pass beyond the bottom end of the female component 22 (as shown in FIG. 12), it is preferred that there be free space below the bottom end of the female component 22 inside the through-duct 7. This free space allows the retaining lips 32 of the male component 23 to turn freely inside the through-duct 7 when the male component 23 is turned about its longitudinal axis. Once turned, one or more locking members 30 on the male component 23 engage one or more locking engagements 26. Also, one or more retaining lips 32 of the male component 23 abuts one or more retaining surfaces 31 at the bottom end of the female component 22. For example, when the male component 23 is inserted into the top opening 27 of the female component 22 and is turned clockwise or counterclockwise approximately 90 degrees, the one or more retaining lips 32 abut the one or more retaining surfaces 31. This prevents the male component 23 from falling out or pulled out of the female component 22 once the wire connector assembly 6 is in locked position. As stated above, the one or more retaining surfaces 31 need not always be in direct contact with the one or more retaining lips 32.

In another embodiment (not shown in the figures), the need for a separate female component 22 may be eliminated by providing for the same or similar features of the female component 22 on the upper portion 20 of the though-duct 7 itself. In this embodiment, the male component 23 may simply be referred to as a wire connector 23. Like the female component 22, upper portion 20 may have one or more locking engagements 26 formed on the interior surface 25 of the upper portion 20 that are shaped to engage one or more locking members 30 formed on an exterior surface of the wire connector 23 when the wire connector 23 is inserted into the upper portion 20 and turned about its longitudinal axis into a locked position. The upper portion 20 may have one or more retaining surfaces 31 that abut one or more retaining lips 32 of the wire connector 23 when the wire connector 23 is inserted into the upper portion 20 and is turned about its longitudinal axis into a locked position. The one or more retaining surfaces 31 may abut one or more of retaining lips 32 of the wire connector 23 when one or more of the locking engagements 26 are engaged to one or more of locking members 30. Within the upper portion 20 of the through-duct 7, there may be free space below the retaining surface 31 of the upper portion 20 of the through-duct 7. The free space allows for the one or more retaining lips 32 of the wire connector 23 to turn freely inside the through-duct 7 when the wire connector 23 is turned about its longitudinal axis.

Figure 13:
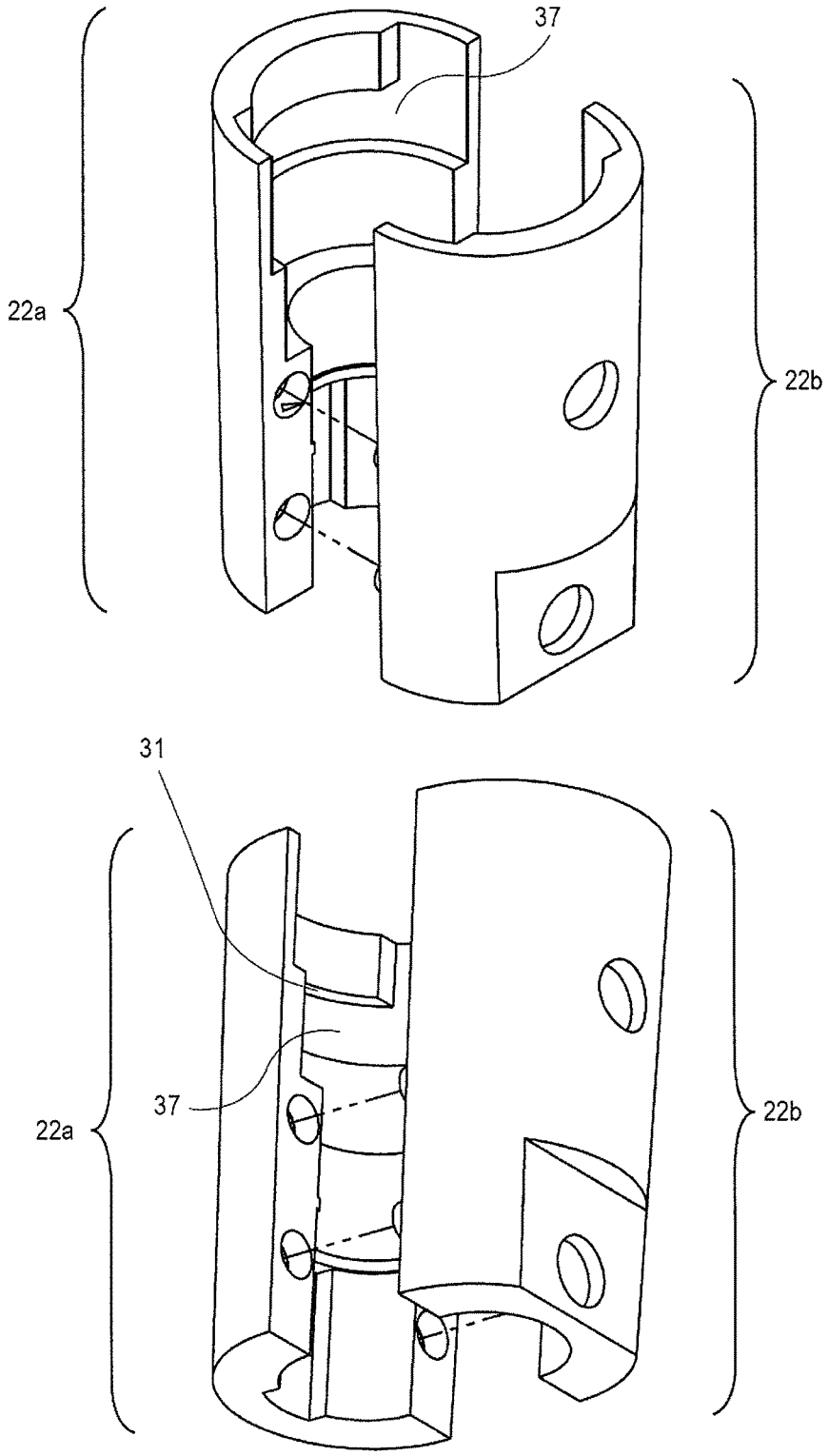
FIG. 13 shows two perspective views of a two-piece female component of a wire connector assembly according to another embodiment.
Figure 14:
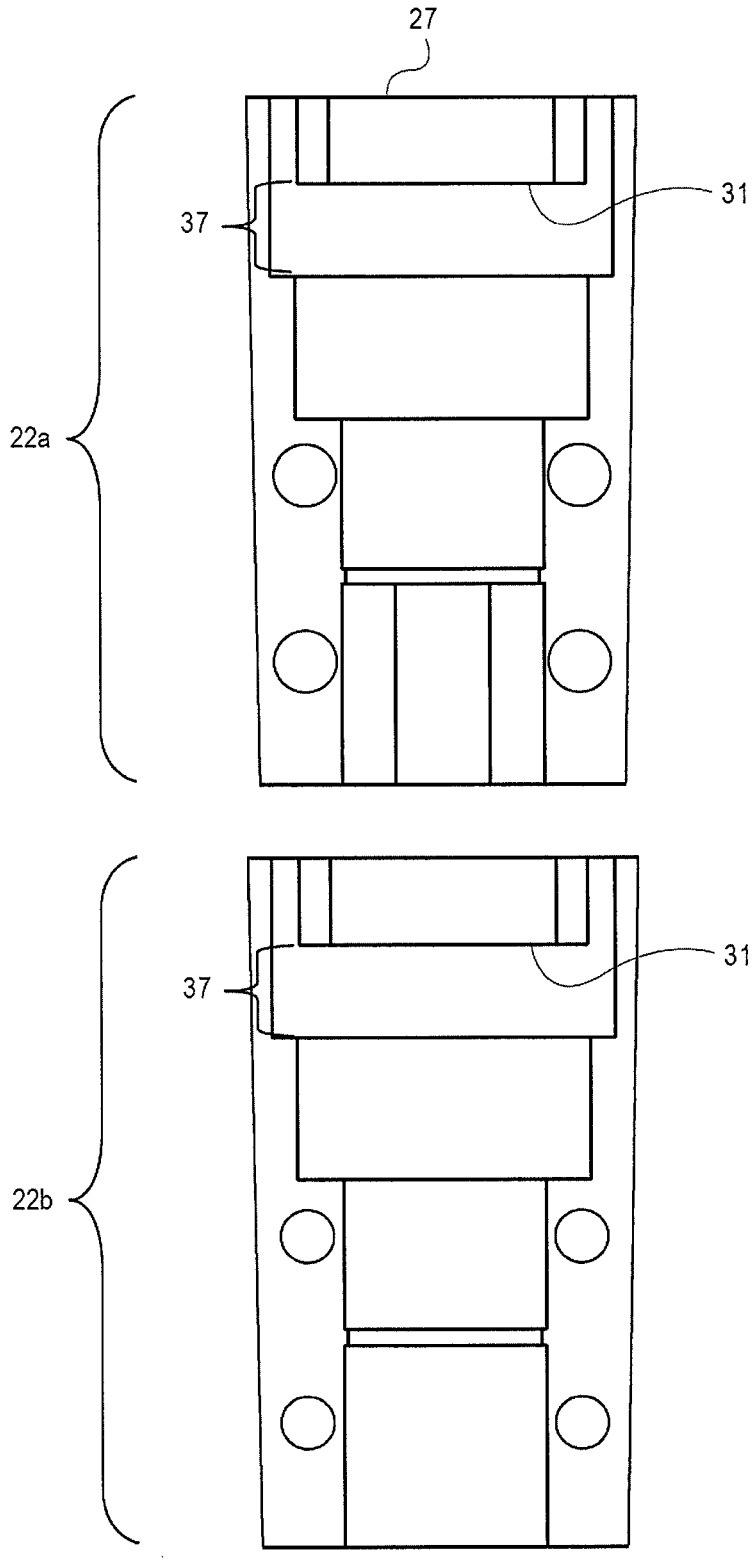
FIG. 14 shows two cross-section views of a two-piece female component of a wire connector assembly according to another embodiment.

FIGS. 13-17 show another embodiment of wire connector assembly 6 having a female component 22 and male component 23. FIGS. 13-14 show another embodiment of female component 22, where the one or more retaining surfaces 31 that abut one or more retaining lips 32 of the male component 23 (shown in FIGS. 15 and 16) are not at the bottom end of the female component 22. Instead, the one or more retaining surfaces 31 are positioned below the top opening 27 within the female component 22. In addition, a gap 37 is within the interior of the female component 22 below the one or more retaining surfaces 31, which provides free space for the retaining lips 32 to move within the female component 22. The top opening 27 of the female component 22 may be elongated in shape to allow the one or more retaining lips 32 to pass through the top opening 27. In this embodiment, the female component here does not have locking engagements 26 as shown in the embodiment depicted in FIGS. 9 and 10. As shown in FIGS. 13 and 14, the female component 22 may be made from two separate pieces 22*a* and 22*b* that can be combined into a single piece 22. Female component 22 (pieces 22*a* and 22*b*) may be held together by a snapping mechanism, glue, or the like.

Figure 15:
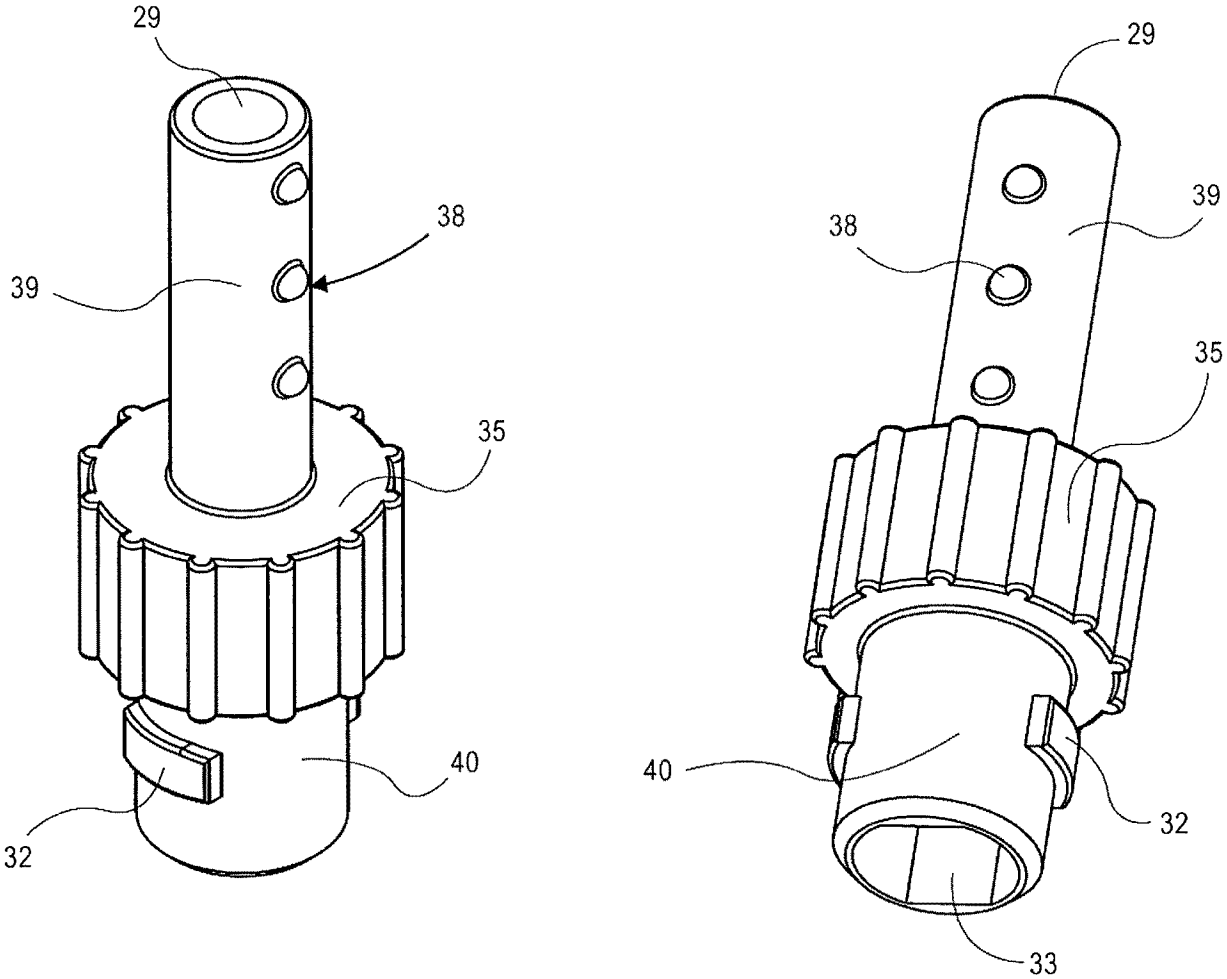
FIG. 15 shows two perspective views of a male component of the wire connector assembly according to another embodiment.

FIG. 15 shows a male component 23 that corresponds to the female component 22 shown in FIGS. 13-14. The one or more retaining lips 32 are not at the bottom end of the male component 23, but in between the grip section 35 and the bottom end. In addition, the male component 23 does not have locking members 30 in between the grip section 35 and the bottom end of the male component 23. In other respects, the male component 23 shown in FIG. 15 is similar to that shown in FIG. 11.

Figure 16:
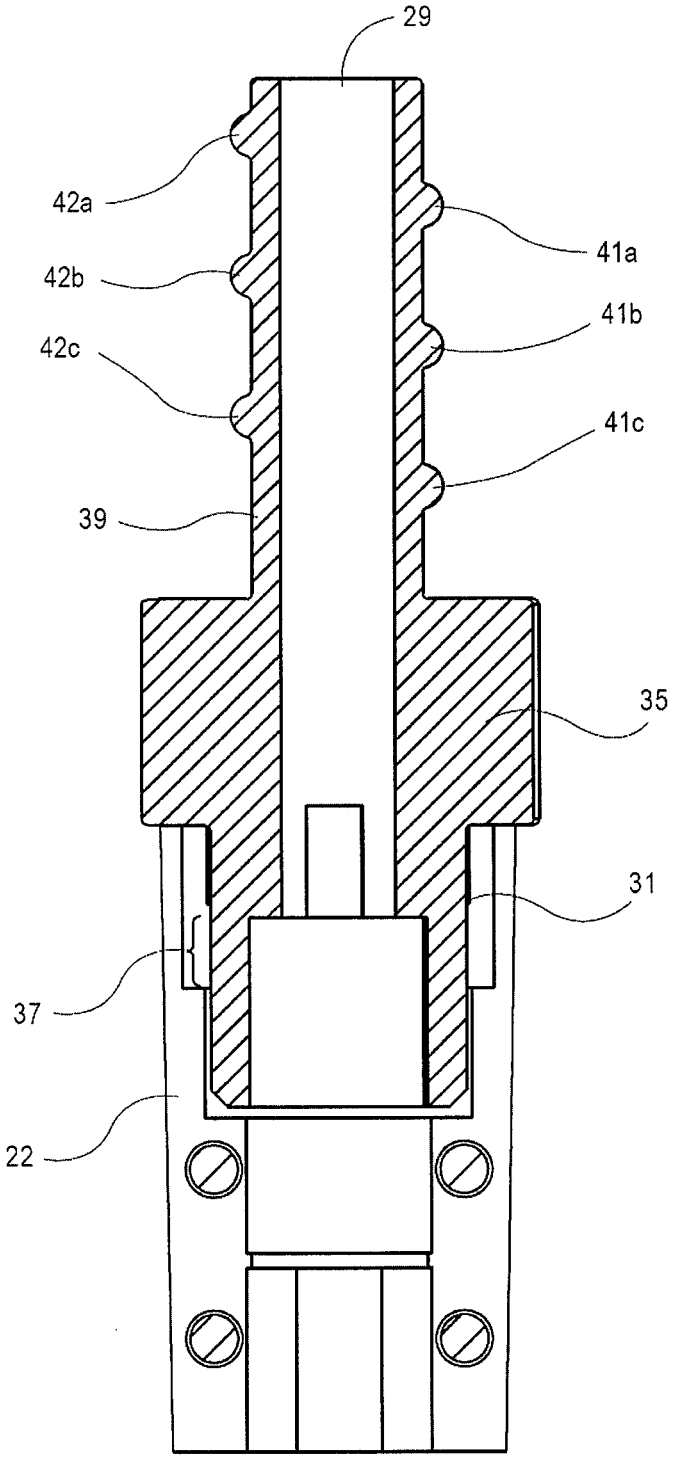
FIG. 16 shows a cross section view of the wire connector assembly according to another embodiment.

FIG. 16 shows a cross section view of wire connector assembly 6 with the male component 23 (shown in FIG. 15) inserted into the female component 22 (shown in FIGS. 13 and 14) and placed in a locked position. When the bottom end of the male component 23 is inserted into the top opening 27 of the female component 22, the one or more retaining lips 32 of the male component 23 passes below the one or more retaining surfaces 31 of the female component 22. Below the retaining surface 31, the female component 22 has a gap 37 that provides sufficient space for the one or more retaining lips 32 of the male component 23 to turn freely inside the female component 22 when the male component 23 is turned about its longitudinal axis. Once the one or more retaining lips 32 of the male component 23 pass below the one or more retaining surfaces 31 of the female component 22 into the gap 37 and the male component 23 is turned about its longitudinal axis, the one or more retaining lips 32 of the male component 23 abuts one or more retaining surfaces 31. For example, when the male component 23 is inserted into the top opening 27 of the female component 22 and is turned clockwise or counter-clockwise approximately 90 degrees, the one or more retaining lips 32 abut the one or more retaining surfaces 31. In this locked position, the male component 23 cannot be easily pulled out of the female component 22. As mentioned above, in the embodiment shown in FIGS. 13-17, the female component 22 does not have one or more locking engagements 26 and the male component 23 does not have one or more locking members 30.

Figure 17:
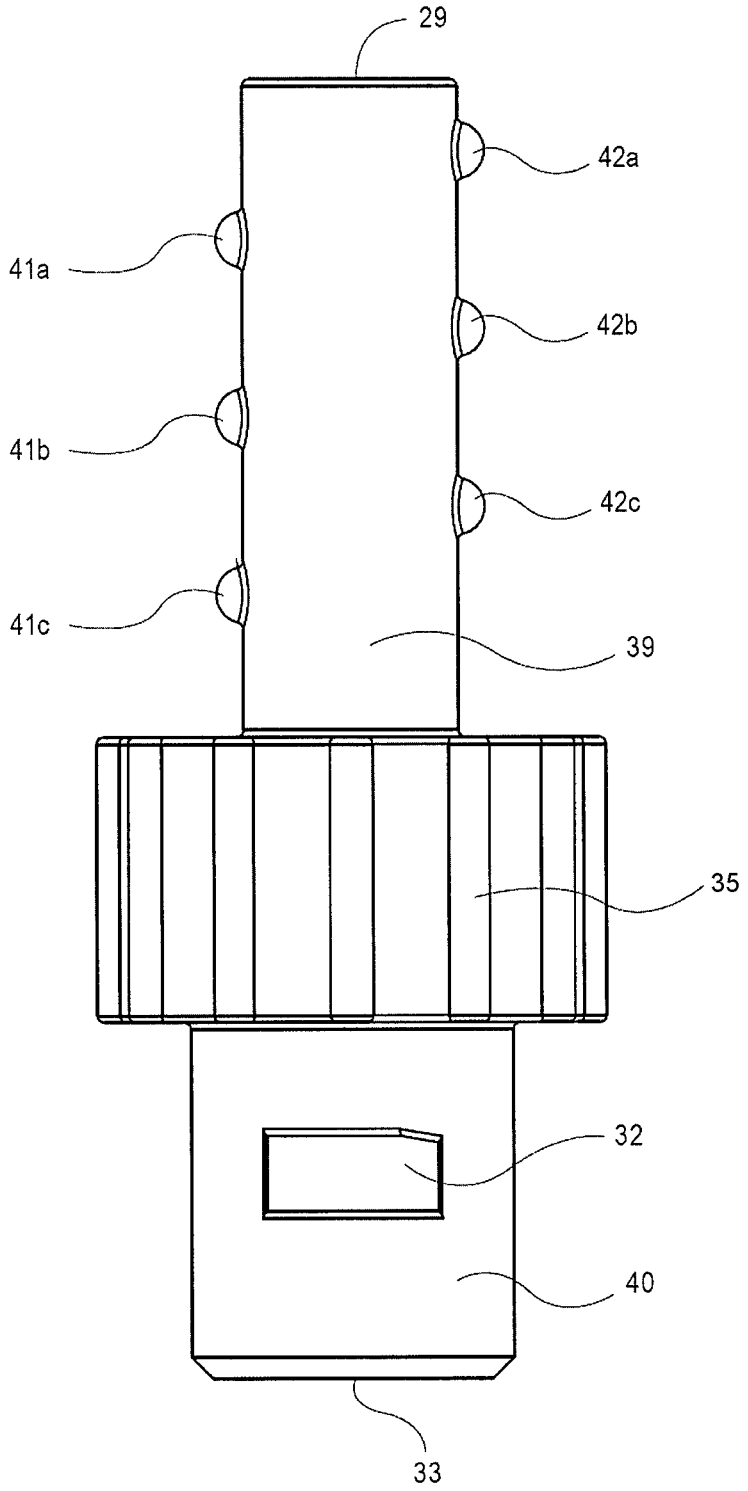
FIG. 17 shows a side view of the male component of the wire connector assembly according to another embodiment.

The upper exterior surface 39 of the male component 23 (or wire connector 23) may have multiple rounded threading bumps 38 that may be threaded into a flexible conduit 11. The flexible conduit 11 may have threads on its interior surface that have a corresponding pitch in relation to the rounded threading bumps 38. FIG. 17 shows a side view of the male component 23 or wire connector 23 according to one embodiment. In between the top end of the wire connector 29 and grip section 35, there are multiple rounded threading bumps 38 on the upper exterior surface 39 of the wire connector 23. As shown in FIG. 17, in one embodiment, a first set 41(*a, b, c*) of rounded threading bumps 38 are positioned longitudinally along the upper exterior surface 39 of the wire connector 23. There is also a second set 42(*a, b, c*) of rounded threading bumps 38 positioned longitudinally along the exterior surface 39 of the wire connector 23. The number of threading bumps may vary. The rounded threading bumps 38 of the first set 41 and the second set 42 are on opposite sides of a longitudinal cross section plane of the wire connector 23. The longitudinal distance between one rounded threading bump 41*a* and the next rounded threading bump 41*b*, for example, of the first set 41 represents a pitch distance of a thread. Similarly, the longitudinal distance between one rounded threading bump 42*a* and the next rounded threading bump 42*b* of the second set 42 represents a pitch distance of a thread. The height difference between the rounded threading bumps 38 of the first set 41 and the second set 42 is half of the pitch distance. This allows the wire connector 23 or male component 23 to be twisted into a flexible conduit 11 that has threads of a corresponding pitch distance. The embodiment shown in FIG. 11 may have the same arrangement of threading bumps. In another embodiment, as shown in FIG. 1, there may be multiple subsets of two threading bumps (instead of one threading bump) that conform to the thread on the interior surface of the flexible conduit 11.

Figure 18:
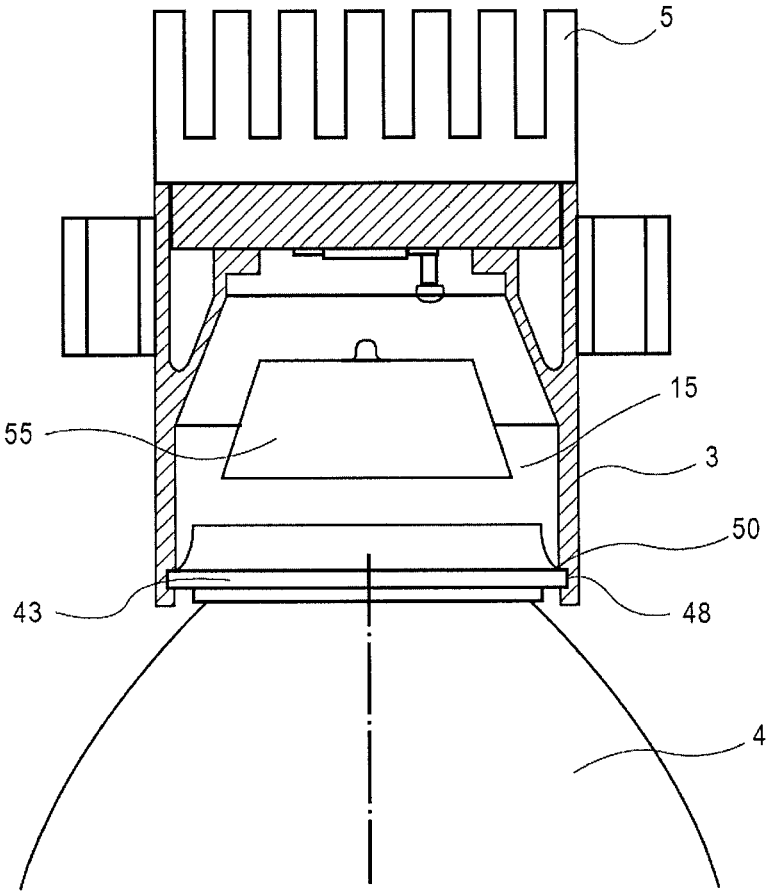
FIG. 18 shows a cross section view of a snap-on lighting trim assembly and its components, including an interface module, lighting trim, flexible retainer ring, and a reflector.

A snap-on lighting trim assembly for a recessed lighting unit 1 is also disclosed. FIG. 18 shows a cross section view of the snap-on lighting trim assembly including a housing 3, flexible retainer ring 43, a reflector 55, heat sink 5, and a lighting trim 4. The housing 3 in which a top opening 12 and a bottom opening 13 are open to a cavity 15. The cavity 15 may be defined in part by an inner surface 16 of a vertical sidewall of the housing 3, wherein at least a portion of the inner surface 16 is cylindrical. Near the bottom portion of the housing 3, there is an indentation 48 along the circumference of a horizontal cross-section plane of the inner surface 16. The indentation 48 is capable of having a flexible retainer ring 43 positioned therein.

Figure 19:
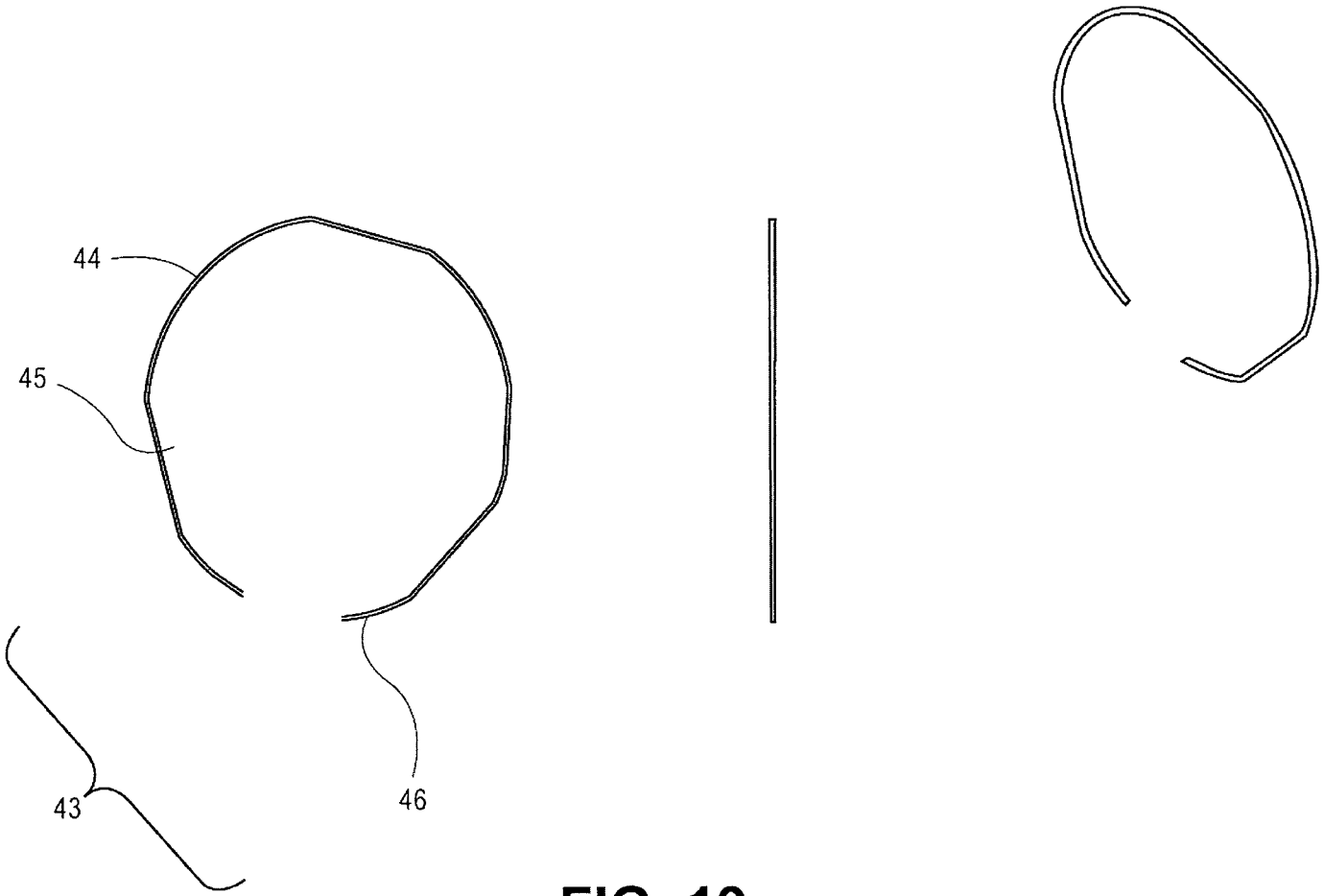
FIG. 19 an overhead view, a side view, and a perspective view of a flexible retainer ring according to one embodiment.

FIG. 19 shows an overhead view, a side view, and a perspective view of a flexible retainer ring 43 according to one embodiment. The flexible retainer ring 43 is a part of a snap-on lighting trim assembly. The flexible retainer ring 43 is used for coupling a lighting trim 4 to an interface module housing 3 without the need for screws, adhesives, or tools. The flexible retainer ring 43 has alternating arcuate sections 44 and linear sections 45, and two arcuate ends 46, wherein the flexible retainer ring 43 generally forms an incomplete circle on a plane. The flexible retainer ring 31 may be resilient and made of metal or polymer. The flexible retainer ring 43 is positioned inside the indentation 48 of the housing 3 before the lighting trim 4 is engaged.

Figure 20:
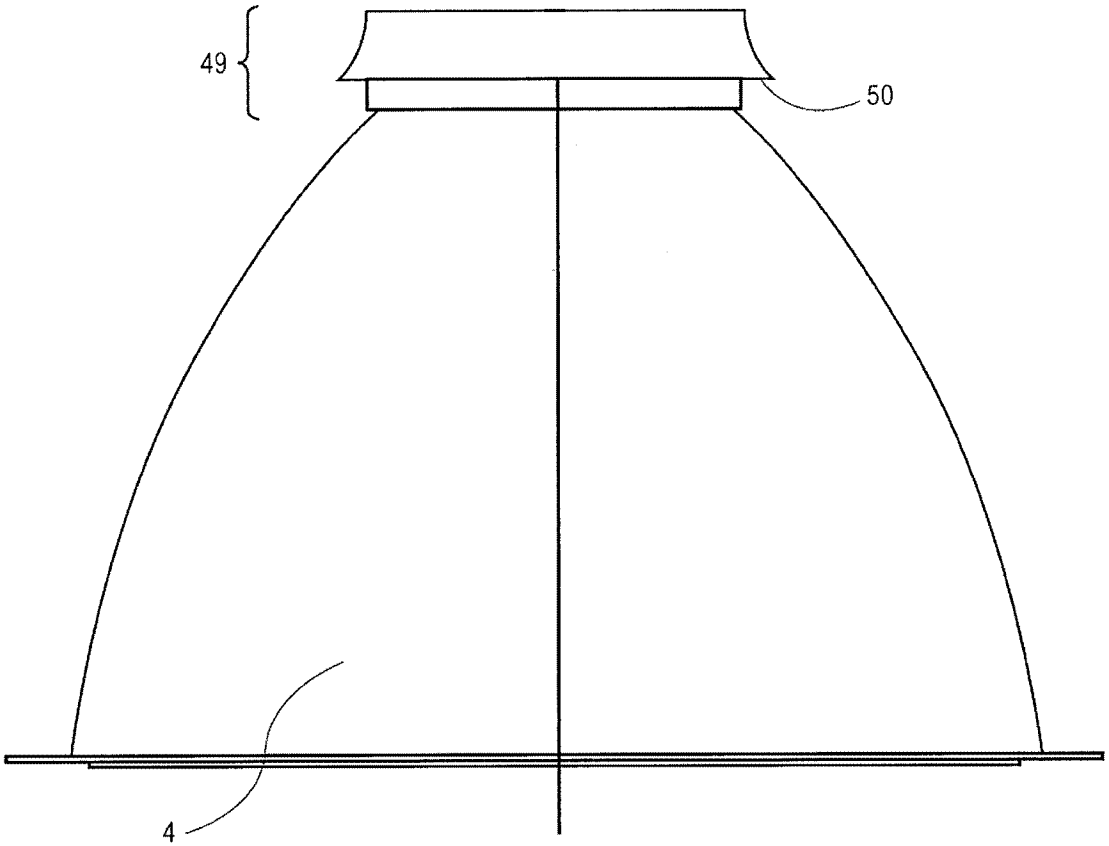
FIG. 20 shows a side view of a lighting trim with a recessed base and a retaining edge, according to one embodiment.

FIG. 20 shows a side view of the lighting trim 4 of the snap-on lighting trim assembly according to one embodiment. The lighting trim 4 has a recessed base 49 that forms a closed curve, wherein an external surface of the recessed base 49 has a retaining edge 50 extending radially outward along a circumference of a horizontal cross-section plane of the recessed base 49. While the flexible retainer ring 43 is positioned in the indentation 48 of the housing 3, the recessed base 49 of the lighting trim 4 is inserted into the bottom opening 13 of the housing 3. The flexible retainer ring 43 bends to allow the recessed base 49 into the bottom opening 13 until the retaining edge 50 passes the flexible retainer ring 43. Because the flexible retainer ring 43 may be resilient, the linear sections 45 may approximately return to its original shape and contact the retaining edge 50 at its bottom, and prevent the lighting trim 4 from being pulled out of the housing 3. It is understood that the flexible retainer ring 43 need not return to its exact original shape while holding the lighting trim 4 in place. No tools are required to engage the lighting trim 4 to the housing 3.

Figure 21:
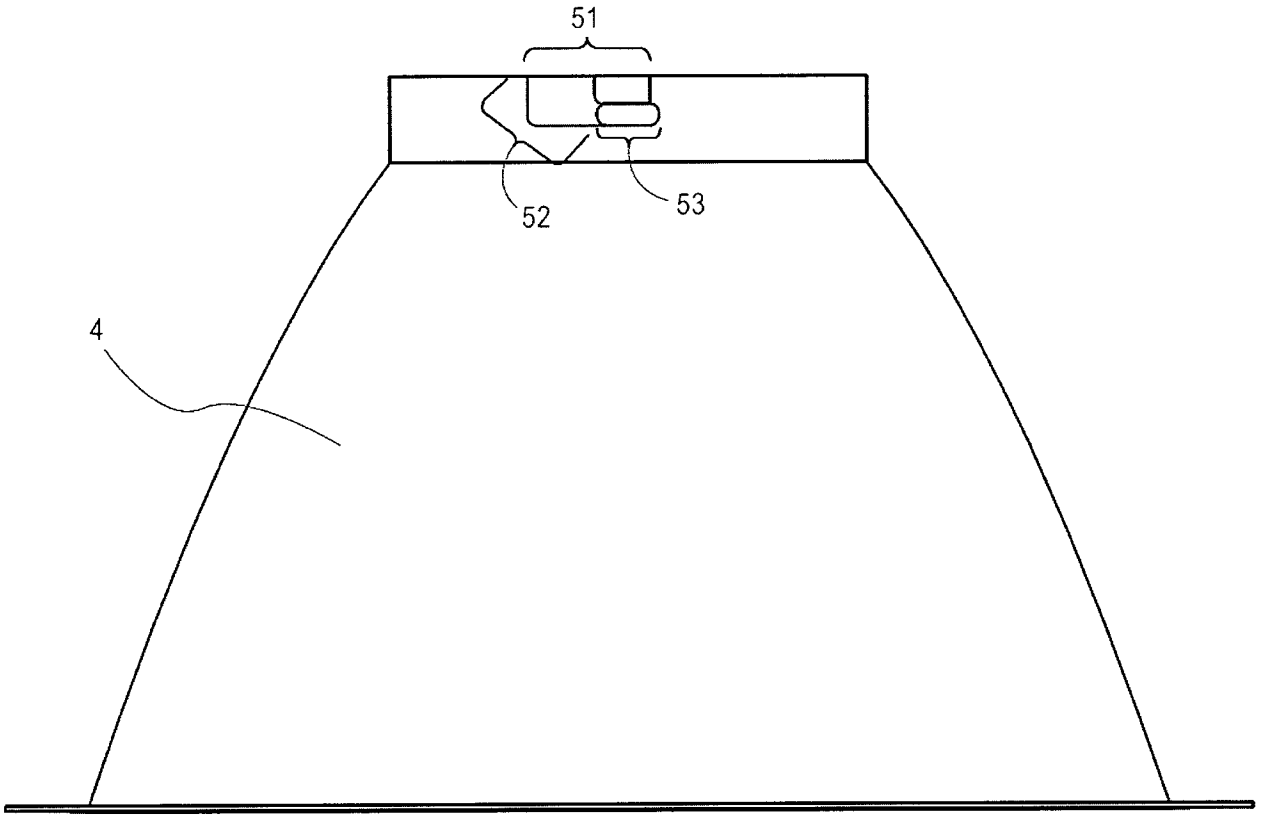
FIG. 21 shows a side view of a lighting trim with a recessed base and a notch, according to another embodiment.

In another embodiment, there may be a lighting trim assembly 1 with a twist and lock mechanism. FIG. 21 shows a side view of one embodiment of lighting trim 4. Lighting trim 4 may have a recessed base 49 that has a notch 51 with a vertical opening portion 52 and a horizontal opening portion 53. As shown in FIG. 8*a*, housing 3 may have a side tab 54 extending outwardly from the exterior surface of the housing 3 that is shaped to engage a notch 51 on a lighting trim 4. The lighting trim 4 is capable of being engaged to the housing 3 by inserting the side tab 54 into the vertical opening portion 52 and twisting the lighting trim 4 so that the side tab 54 is inserted into the horizontal opening portion 53 into a locked position. FIG. 1 shows a lighting trim assembly 1 with the lighting trim 4 engaged to a housing 3 with the twist and lock mechanism in a locked position.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A recessed lighting unit comprising:

a housing having an outer surface, an inner surface, and a bottom opening that is open to a cavity, the cavity being defined in part by an inner surface of the housing, wherein the housing has a through-duct formed therein, the through-duct having a first through-duct opening in the outer surface that leads to a second through-duct opening in the inner surface, wherein the through-duct has an upper portion and a lower portion, between the first through-duct opening and the second through-duct opening, and the lower portion forms an elbow between the upper portion and the second through-duct opening.

2. The recessed lighting unit of claim 1 further comprising:

a wire connector assembly having a female component and a male component;

wherein the female component of the wire connector assembly has a retaining surface that abuts a retaining lip of a male component of the wire connector assembly when the male component of the wire connector assembly is positioned inside the female component and placed in a locked position, wherein the female component of the wire connector assembly is positioned in the upper portion of the through-duct.

3. The recessed lighting unit of claim 2, wherein the male component of the wire connector assembly further comprises:

a top end with an opening and a bottom end with an opening;

a hollow interior running longitudinally from the top end to the bottom end; and an exterior surface from which the retaining lip extends outwardly.

4. The recessed lighting unit of claim 3, wherein the male component of the wire connector assembly further comprises:

a grip section formed on the exterior surface of the male component between the top end and the bottom end.

5. The recessed lighting unit of claim 4, wherein the male component of the wire connector assembly further comprises:

a plurality of rounded threading bumps on the exterior surface of the male component between the top end and the grip section.

6. The recessed lighting unit of claim 5, wherein the plurality of rounded threading bumps further comprises:

a first set of rounded threading bumps positioned longitudinally along the exterior surface of the male component of the wire connector assembly;

a second set of rounded threading bumps positioned longitudinally along the exterior surface of the male component of the wire connector assembly;

wherein the rounded threading bumps of the first set and the second set are on opposite sides of a longitudinal cross section plane of the male component of the wire connector assembly, wherein the longitudinal distance between one rounded threading bump and the next rounded threading bump of the first set represents a pitch distance of a thread, wherein the longitudinal distance between one rounded threading bump and the next rounded threading bump of the second set represents the pitch distance of the thread, wherein the height difference between the rounded threading bumps of the first set and the second set is half of the pitch distance.

7. The recessed lighting unit of claim 4, wherein the male component of the wire connector assembly further comprises:

a locking member formed on the exterior surface of the male component between the grip section and the bottom end.

8. The recessed lighting unit of claim 7, wherein the female component of the wire connector assembly further comprises:

a locking engagement formed on the interior surface of the female component that is shaped to engage the locking member when the male component is positioned inside the female component and placed in a locked position.

9. The recessed lighting unit of claim 1, wherein the upper portion of the through-duct further comprises:

a retaining surface that abuts a retaining lip of a wire connector when the wire connector is positioned inside the upper portion and placed in a locked position.

10. The recessed lighting unit of claim 9, wherein the wire connector further comprises:

a top end with an opening and a bottom end with an opening;

a hollow interior running longitudinally from the top end to the bottom end; and an exterior surface from which the retaining lip extends outwardly.

11. The recessed lighting unit of claim 10, wherein the wire connector further comprises:

a grip section formed on the exterior surface of the wire connector between the top end and the bottom end.

12. The recessed lighting unit of claim 11, wherein the wire connector further comprises:

a plurality of rounded threading bumps on the exterior surface of the wire connector between the top end and the grip section.

13. The recessed lighting unit of claim 12, wherein the plurality of rounded threading bumps further comprises:

a first set of rounded threading bumps positioned longitudinally along the exterior surface of the wire connector; and a second set of rounded threading bumps positioned longitudinally along the exterior surface of the wire connector;

wherein the rounded threading bumps of the first set and the second set are on opposite sides of a longitudinal cross section plane of the wire connector, wherein the longitudinal distance between one rounded threading bump and the next rounded threading bump of the first set represents a pitch distance of a thread, wherein the longitudinal distance between one rounded threading bump and the next rounded threading bump of the second set represents the pitch distance of the thread, wherein the height difference between the rounded threading bumps of the first set and the second set is half of the pitch distance.

14. The recessed lighting unit of claim 11, wherein the wire connector further comprises:

a locking member formed on the exterior surface of the wire connector between the grip section and the bottom end.

15. The recessed lighting unit of claim 14, wherein the upper portion of the through-duct further comprises:

a locking engagement formed on the interior surface of the upper portion that is shaped to engage the locking member when the wire connector is positioned inside the upper portion and placed in a locked position.

16. The recessed lighting unit of claim 1 further comprising:

a heat sink coupled to the housing through a top opening of the housing.

17. The recessed lighting unit of claim 1 further comprising:

a lighting trim coupled to the bottom opening of the housing.

18. The recessed lighting unit of claim 1, further comprising:

a side tab extending outwardly from the exterior surface of the housing that is shaped to engage a notch on a lighting trim.

19. The recessed lighting unit of claim 18, wherein the notch on the lighting trim has a vertical opening portion and a horizontal opening portion, and wherein the lighting trim is capable of being engaged to the housing by inserting the side tab into the vertical opening portion and twisting the lighting trim so that the side tab is inserted into the horizontal opening portion.

20. A snap-on lighting trim assembly for a recessed lighting unit comprising:

an interface module having:

a housing having a bottom opening that is open to a cavity, the cavity being defined in part by an inner surface of a vertical sidewall of the housing, wherein at least a portion of the inner surface is cylindrical, an indentation along the circumference of a horizontal cross-section plane of the inner surface that also cuts through a cylindrical portion of the inner surface;

a flexible retainer ring made of a wire having a plurality of alternating arcuate sections and linear sections; and a lighting trim having a recessed base that forms a closed curve, wherein an external surface of the recessed base has a retaining edge extending radially outward along a circumference of a horizontal cross-section plane of the recessed base;

wherein the flexible retainer ring is positioned so that its arcuate sections are positioned inside the indentation of the cylindrical portion of inner surface of the housing, wherein the recessed base of the lighting trim is positioned inside the housing, and extends outward through the bottom opening of the housing while the linear sections of the flexible retainer ring abut the retaining edge of the recessed base and prevent the base from being pulled out of the housing.

21. The snap-on lighting trim assembly for a recessed lighting unit of claim 20, wherein the flexible retainer ring is resilient and made of metal or polymer.

22. The snap-on lighting trim assembly for a recessed lighting unit of claim 20 further comprising:

a heat sink coupled to the housing through the top opening of the housing.

23. An interface module for a recessed lighting unit comprising:

a housing having an outer surface, an inner surface, and a bottom opening that is open to a cavity, the cavity being defined in part by an inner surface of the housing, and a side tab extending outwardly from the outer surface of the housing that is shaped to engage a notch on a lighting trim, wherein the housing has a through-duct formed therein, the through-duct having a first through-duct opening in the outer surface that leads to a second through-duct opening in the inner surface, wherein the through-duct forms a pathway between the first through-duct opening and the second through-duct opening.

24. The interface module for a recessed lighting unit of claim 23, wherein the notch on the lighting trim has a vertical opening portion and a horizontal opening portion, and wherein the lighting trim is capable of being engaged to the housing by inserting the side tab into the vertical opening portion and twisting the lighting trim so that the side tab is inserted into the horizontal opening portion.

* * * * *